US010162295B2

(12) United States Patent
Matsumura et al.

(10) Patent No.: US 10,162,295 B2
(45) Date of Patent: Dec. 25, 2018

(54) METHOD FOR FORMING SCRATCHABLE IMAGE AND SCRATCHABLE IMAGE FORMED ARTICLE

(71) Applicant: FUJI XEROX CO., LTD., Tokyo (JP)

(72) Inventors: Yasuo Matsumura, Kanagawa (JP); Satoshi Hiraoka, Kanagawa (JP); Yasuhiro Uehara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,962

(22) Filed: Sep. 8, 2017

(65) Prior Publication Data

US 2018/0224783 A1 Aug. 9, 2018

(30) Foreign Application Priority Data

Feb. 3, 2017 (JP) ..... 2017-018814

(51) Int. Cl.

| | |
|---|---|
| ***G03G 13/08*** | (2006.01) |
| ***G03G 15/20*** | (2006.01) |
| *G03G 9/087* | (2006.01) |
| *G03G 15/16* | (2006.01) |

(52) U.S. Cl.

CPC ..... *G03G 15/2092* (2013.01); *G03G 15/2064* (2013.01); *G03G 9/08711* (2013.01); *G03G 9/08755* (2013.01); *G03G 15/1625* (2013.01)

(58) Field of Classification Search

CPC ..... G03G 13/08

See application file for complete search history.

(56) References Cited

U.S. PATENT DOCUMENTS

| | | | | |
|---|---|---|---|---|
| 5,306,586 | A | 4/1994 | Pai et al. | |
| 8,541,153 | B2 | 9/2013 | Matsumura et al. | |
| 8,592,121 | B2 | 11/2013 | Matsumura | |
| 2009/0236558 | A1* | 9/2009 | Kobayashi | H01F 1/0027 252/62.54 |
| 2013/0065172 | A1* | 3/2013 | Moriya | G03G 9/08755 430/105 |
| 2013/0108953 | A1* | 5/2013 | Kawamura | G03G 9/08711 430/109.3 |
| 2014/0356537 | A1* | 12/2014 | Tyagi | B42D 15/025 427/258 |

FOREIGN PATENT DOCUMENTS

| | | | |
|---|---|---|---|
| JP | 6-83077 | A | 3/1994 |
| JP | 10-157360 | A | 6/1998 |
| JP | 4139643 | B2 | 8/2008 |
| JP | 2008-209489 | A | 9/2008 |
| JP | 2011-043534 | A | 3/2011 |
| JP | 2014-016560 | A | 1/2014 |

* cited by examiner

*Primary Examiner* — Hoa V Le

(74) *Attorney, Agent, or Firm* — Sughrue Mion, PLLC

(57) ABSTRACT

A method for forming a scratchable image includes pressure-fixing a masking pressure toner onto a base image on a substrate to form a masking layer.

19 Claims, No Drawings

METHOD FOR FORMING SCRATCHABLE IMAGE AND SCRATCHABLE IMAGE FORMED ARTICLE

CROSS-REFERENCE TO RELATED APPLICATIONS

This application is based on and claims priority under 35 USC 119 from Japanese Patent Application No. 2017-018814 filed Feb. 3, 2017.

BACKGROUND (i) Technical Field

The present invention relates to a method for forming a scratchable image and a scratchable-image-formed article.

(ii) Related Art

Scratchable images have a masking layer (scratchable masking layer) formed of a removable ink and have come to be widely used in scratch tickets, lotteries, advertising mails, and advertisement sheets.

The scratchable masking layer has masking properties that keep a base image from being visually recognized from outside and removing properties that enable the scratchable masking layer to be removed by being scratched with coins and nails to make the base image being visually recognized.

The scratchable masking layer have been typically formed by offset printing, gravure printing, screen printing, or another printing.

SUMMARY

According to an aspect of the invention, there is provided a method for forming a scratchable image, the method including pressure-fixing a masking pressure toner onto a base image on a substrate to form a masking layer.

DETAILED DESCRIPTION

Exemplary embodiments of the invention will now be described in detail.

Method for Forming Scratchable Image

A method for forming a scratchable image according to a first exemplary embodiment includes pressure-fixing a masking pressure toner onto a base image on a substrate to form a masking layer.

In formation of a scratchable image, a masking image is formed of a removable ink. Such a scratchable image has come to be widely used in scratch tickets, lotteries, advertising mails, and advertisement sheets.

In the case where images are formed on a small number of sheets by electrophotography, the costs thereof per sheet are low. In addition, electrophotographic formation of images is highly flexible, for example, in image design, excellent in on-demand properties, and useful particularly in formation of images on a small number of sheets.

The inventors have studied electrophotographic formation of scratchable images; however, traditional techniques involving use of thermoplastic toner cause a masking layer to be easily removed, and damage of a base image and a residual masking layer impair visibility of the base image in some cases after removal of the masking layer.

The method for forming a scratchable image according to the first exemplary embodiment includes pressure-fixing a masking pressure toner onto a base image on a substrate to form a masking layer.

This method enables formation of a scratchable image of which the base image is well visible after removal of the masking layer. The mechanism thereof has been still studied but is speculated as follows.

In the case where a masking layer is formed of only a typical thermoplastic toner, the masking layer and a base image have no definite differences in fixability and physical properties; hence, removal of the masking layer damages the base image and impairs the visibility thereof after the removal in some cases.

Formation of the masking layer by pressure fixing of a masking pressure toner is presumed to produce differences in fixability and physical properties between the base image and the masking layer, enable easy removal of the masking layer, and thus give the base image excellent visibility after the removal.

Furthermore, the method for forming a scratchable image according to the first exemplary embodiment enables easy on-demand formation of a scratchable image as described above.

The method for forming a scratchable image according to the first exemplary embodiment will now be described in detail.

Substrate

The substrate used in the method for forming a scratchable image according to the first exemplary embodiment at least has a base image on its surface.

The masking layer is formed on the base image.

In the substrate used in the method for forming a scratchable image according to the first exemplary embodiment, the masking layer is formed on the base image; in addition, an image may be optionally formed on part of the substrate at which the masking layer has not been formed, and the masking layer may be optionally further formed on part of the substrate at which the base image has not been formed.

The term "(base) image" used in the first exemplary embodiment refers not only to pictorial images but also to comprehensive images including characters and sentences.

The base image may be formed either of ink and toner; in terms of the visibility of the base image after removal of the masking layer, the base image is suitably formed of a thermoplastic toner.

The base image can be formed of any ink and toner, and any of known inks and toners can be used.

Any type of substrates can be used in the first exemplary embodiment, and any of known recording media can be used.

The substrate can be, for example, paper or a resin sheet. Examples thereof include plain paper used in electrophotographic copying machines and printers and OHP sheets.

In particular, the substrate is suitably a substrate having a smooth surface. Suitable examples of such a substrate include coated paper in which the surface of plain paper has been coated with resin or another material and art paper used in formation of images.

The substrate can have any width, thickness, and shape. Predetermined width, thickness, and shape can be employed.

In the method for forming a scratchable image according to the first exemplary embodiment, the base image and the masking layer are suitably in direct contact with each other.

In typical methods for forming a scratchable image, a release layer is formed of varnish and another material on the base image in terms of easy removal of the masking layer in some cases; however, in the method for forming a scratchable image according to the first exemplary embodiment, the masking layer formed by pressure fixing of a masking pressure toner is excellent in removability, which eliminates use of the release layer.

The substrate used in the method for forming a scratchable image according to the first embodiment may have the base image on at least one side thereof and may have the base image on both sides thereof. The base image may be formed on the entire surface of the substrate or on part of the surface.

The method for forming a scratchable image according to the first exemplary embodiment suitably includes preparing the substrate having the base image.

In the method for forming a scratchable image according to the first exemplary embodiment, a preliminarily prepared substrate with the base image may be used, or a substrate having the base image may be produced.

Pressure Fixing

In the method for forming a scratchable image according to the first exemplary embodiment, the masking pressure toner is pressure-fixed to form the masking layer.

Pressure applied in the pressure fixing of the masking pressure toner (also referred to as "fixing pressure") depends on the composition and physical properties of the masking pressure toner to be used; the maximum pressure is preferably approximately from 1 MPa to 20 MPa, more preferably from 2 MPa to 16 MPa, and further preferably from 3 MPa to 14 MPa. The maximum pressure within such a range gives the masking layer excellent formability and fixability.

Pressure can be applied in the pressure fixing of the masking pressure toner by any technique with any device, and any of known techniques for applying pressure, such as techniques involving use of known fixing devices, can be used; for example, pressure can be applied with a pressure fixing roller.

Examples of the pressure fixing roller include pressure fixing rollers having a cylindrical metal core coated with a fluorine resin [for instance, Teflon (registered trademark)], a silicone resin, or perfluoroalkylate. In addition, a pressure fixing roller made of SUS steel may be used to gain high fixing pressure. In pressure fixing with such a pressure fixing roller, the substrate is generally allowed to pass through two rollers; the two rollers may be made of the same material or different materials. Examples of a combination of the materials include SUS and SUS, SUS and a silicon resin, SUS and PFA, and PFA and PFA.

In the first exemplary embodiment, the pressure distribution of, for example, the pressure fixing roller can be measured with a commercially available pressure-distribution-measuring sensor; for instance, it can be specifically measured with an inter-roller pressure measuring system manufactured by KAMATA Industry Co., Ltd. In the first exemplary embodiment, the maximum of the fixing pressure refers to the maximum degree of a change in pressure from the input of a fixing nip to the output in the direction in which the substrate passes.

In the first exemplary embodiment, the pressure fixing is suitably performed without heating. The term "pressure fixing without heating" herein refers to that a unit which directly heats a pressure-fixing unit is not provided. Hence, an increase in the internal temperature of an apparatus to environmental temperature or higher due to, for instance, heat generated by another energy source is not eliminated.

The pressure-fixing temperature is preferably approximately from 15° C. to 50° C., more preferably from 15° C. to 45° C., and further preferably from 15° C. to 40° C. The pressure-fixing temperature within such a range gives good fixability.

The masking layer that is to be formed may have any thickness, and a predetermined thickness can be employed; in view of masking properties and fixability, the thickness is preferably from 1 μm to 50 μm, more preferably from 3 μm to 40 μm, and further preferably from 5 μm to 30 μm.

Masking Pressure Toner

The masking pressure toner used in the first exemplary embodiment is not particularly limited provided that it exhibits plastic behavior against pressure and has masking properties. The masking pressure toner is preferably a toner that contains toner particles containing a binder resin, a colorant, and a release agent, and more preferably a toner containing such toner particles and external additives.

The masking pressure toner used in the first exemplary embodiment may be a single pressure-plastic toner or a mixture of a thermoplastic toner and a pressure-plastic toner.

The masking pressure toner used in the first exemplary embodiment is preferably a mixture of a thermoplastic toner and a pressure-plastic toner, and more preferably a mixture of a thermoplastic toner having masking properties and a transparent pressure-plastic toner in view of the visibility of the base image after removal of the masking layer and easy control of the physical properties.

In the case of using the mixture of a thermoplastic toner and a pressure-plastic toner as the masking pressure toner, application of pressure causes the pressure-plastic toner to be deformed and flow between thermoplastic toner particles, which imparts pressure-plastic properties to the whole toner. In addition, the pressure-plastic toner serves as a kind of an adhesive, which helps the formation of the masking layer by the pressure fixing of the toner.

In use of the mixture of a thermoplastic toner and a pressure-plastic toner, a pressure-plastic transparent toner can be mixed with, for example, multiple existing thermoplastic colored toners (silver toner, gold toner, cyan toner, magenta toner, and yellow toner) to form the masking layer having a predetermined hue.

The thermoplastic toner used in the first exemplary embodiment is not particularly limited, and any of known thermoplastic toners can be used.

In particular, the thermoplastic toner is preferably a thermoplastic toner containing a masking agent, which will be described later, and more preferably a thermoplastic toner containing a masking agent such as a metallic pigment in view of the visibility of the base image after removal of the masking layer and easy control of the physical properties.

In the case where the masking pressure toner used in the first exemplary embodiment is a mixture of a thermoplastic toner and a pressure-plastic toner, the mass ratio of the thermoplastic toner to the pressure-plastic toner is preferably approximately from 60:40 to 95:5, and more preferably from 70:30 to 90:10 in view of the visibility of the base image after removal of the masking layer, masking properties, and fixability.

The ratio of the thermoplastic toner to the pressure-plastic toner in terms of the volume average particle size is preferably from 5:1 to 1:5, and more preferably from 2:1 to 1:2 in view of the visibility of the base image after removal of the masking layer, masking properties, and fixability.

Plastic Behavior against Pressure

In general, plasticity is a property defined as follows: when force is applied to a solid to deform it beyond the elastic limit and the deformation remains even though the solid is released from the force, this solid has a plasticity. When toner is deformed by application of pressure thereto and the deformation remains, the toner has a pressure plasticity. The toner with pressure plasticity, which is used in the first exemplary embodiment, preferably satisfies the following expression; and more preferably satisfies the following expression, exhibits plastic behavior against pressure in a non-heated state, and has a fluidity under application of pressure of a predetermined degree or more.

$$20° C. \leq T(1 \text{ MPa}) - T(10 \text{ MPa})$$

In the expression, T(1 MPa) represents a temperature at which the viscosity is approximately $10^4$ Pa·s at an applied pressure of approximately 1 MPa and which is measured with a flow tester. T(10 MPa) represents a temperature at which the viscosity is approximately $10^4$ Pa·s at an applied pressure of approximately 10 MPa and which is measured with a flow tester.

The temperature difference represented by T(1 MPa)−T (10 MPa) (also referred to as "temperature difference ΔT") is 20° C. or more, preferably 40° C. or more, more preferably 60° C. or more, and further preferably from 60° C. to 120° C. At a temperature difference ΔT of 20° C. or more, the plastic behavior against pressure is sufficient, and excellent pressure-fixability are therefore produced.

The temperature difference ΔT is preferably 120° C. or less, and more preferably 100° C. or less. At a temperature difference ΔT of 120° C. or less, toner is not unnecessarily soft and therefore has excellent fixability.

T(10 MPa) is preferably 140° C. or less, more preferably 130° C. or less, and further preferably 120° C. or less. At T(10 MPa) of 140° C. or less, toner can be easily fixed merely by application of pressure using a normal pressure-applying unit with a reduced amount of heat applied to a substrate or without heating a substrate in the fixing.

T(10 MPa) is preferably 60° C. or more, more preferably 65° C. or more, and further preferably 70° C. or more. At T(10 MPa) of 60° C. or more, toner has an excellent fixability.

The temperature difference ΔT is measured with a flow tester. An example of the flow tester is a flow tester CFT-500 manufactured by SHIMADZU CORPORATION.

Specific measurement of the temperature difference ΔT is as follows.

The toner is compressed into a solid to prepare a sample being in the form of a pellet. The sample is placed in a flow tester, the measurement temperature is slowly increased from 50° C. within the range of 50° C. to 150° C. (rate of temperature increase: +1° C./min), and the viscosity of the sample is measured under application of a predetermined extrusion pressure. The applied pressure is fixed to be 1 MPa, and viscosity at 1 MPa for each temperature is measured. From the graph of the obtained viscosities, the temperature T(1 MPa) at which the viscosity at the applied pressure of 1 MPa is $10^4$ Pa·s is determined. T(10 MPa) is determined as in the determination of T(1 MPa) except that the applied pressure of 1 MPa is changed to 10 MPa. The temperature difference ΔT [T(1 MPa)−T(10 MPa)] is calculated from the obtained T(1 MPa) and T(10 MPa).

Binder Resin

A binder resin used in the thermoplastic toner in the first exemplary embodiment can be any of known thermoplastic resins and is suitably a styrene-acrylic resin or a polyester resin.

Any binder resin can be used in the pressure-plastic toner in the first exemplary embodiment provided that the toner satisfies the above-mentioned expression, and any of known resins that exhibit plastic behavior against pressure is used; in view of the visibility of the base image after removal of the masking layer, a resin containing baroplastic is suitably used. In other words, the masking pressure toner used in the first exemplary embodiment suitably contains a pressure-plastic toner containing a baroplastic resin in view of the visibility of the base image after removal of the masking layer.

Baroplastic is a resin having a pressure fluidity and suitably a block copolymer produced by at least combining a resin having a high glass transition temperature and a resin having a low glass transition temperature.

In the case where the resin having a high glass transition temperature and the resin having a low glass transition temperature are in a state of a micro phase separation, as in the case where the resins constitute the individual blocks of a block copolymer, these resins exhibit plastic behavior against pressure and fluidity even in a normal temperature range under application of pressure of a predetermined degree or more. Such resins are called baroplastic.

Two suitable examples of the baroplastic used in the first exemplary embodiment will now be described.

Baroplastic

First Example

The pressure-plastic toner used in the first exemplary embodiment suitably at least contains two resins having a difference in glass transition temperature (Tg) in view of the easy occurrence of plastic behavior on application of pressure. In the case where the pressure-plastic toner used in the first exemplary embodiment at least contains such two resins, the toner is likely to have a phase-separated structure. Hence, the toner is likely to have a fluidity under application of pressure of a predetermined degree or more, and excellent pressure fixability are therefore easily produced.

In the case where the pressure-plastic toner used in the first exemplary embodiment contains three or more resins, at least two of them may have a difference in glass transition temperature.

In the pressure-plastic toner used in the first exemplary embodiment, the difference in glass transition temperature between the two resins is preferably approximately 30° C. or more, and more preferably 35° C. or more. In the case where the difference in glass transition temperature between the two resins is approximately 30° C. or more, the toner containing such two resins is easy to be fixed at reduced pressure.

The pressure-plastic toner used in the first exemplary embodiment may contain three or more resins, and at least two of them suitably have the above-mentioned relationship.

In the two resins, the amount of the one having a higher glass transition temperature is preferably approximately from 5 mass % to 70 mass %, more preferably from 10 mass % to 60 mass %, and further preferably from 20 mass % to 50 mass % relative to the total mass of the two resins. In the case where the amount of the resin having a higher glass transition temperature is approximately from 5 mass % to 70 mass %, the toner has an excellent fixability at reduced pressure.

In the case where the pressure-plastic toner used in the first exemplary embodiment contains three or more different resins, the amount of the two resins is properly from 80 mass % to 99 mass %, and preferably from 85 mass % to 95 mass % relative to the total mass of the three or more different resins. In the case where the amount of the two resins is from 80 mass % to 99 mass %, the toner has an excellent fixability at reduced pressure.

At least one of the two resins having a difference in glass transition temperature preferably has a glass transition temperature of approximately 40° C. or more, more preferably 45° C. or more, and further preferably 50° C. or more. At a glass transition temperature of approximately 40° C. or more, the toner is likely to have an excellent storage stability.

The amount of the resin having a glass transition temperature of approximately 40° C. or more is properly 5 mass % to 70 mass %, preferably from 10 mass % to 60 mass %, and more preferably from 20 mass % to 50 mass % relative to the mass of the two resins having a difference in glass transition temperature.

In the two resins, the one having a higher glass transition temperature properly has a glass transition temperature of approximately 40° C. or more, preferably approximately 40° C. or more and less than 60° C., and more preferably approximately 40° C. or more and less than 55° C. At a glass transition temperature of less than 60° C., pressure fixing with application of pressure at normal temperature (inner pressure of system: 50° C. or less) is easy to be performed.

In the two resins, the one having a lower glass transition temperature properly has a glass transition temperature of approximately less than 10° C., preferably approximately −100° C. or more and less than 10° C., and more preferably approximately −80° C. or more and less than 10° C. At a glass transition temperature of approximately less than 10° C., fixing at reduced pressure is easy to be performed.

The pressure-plastic toner used in the first exemplary embodiment may contain three or more different resins; in this case, it is suitable that the difference in glass transition temperature between two of them be approximately 30° C. or more and that at least one of the two have a glass transition temperature is approximately 40° C. or more.

The same in "two resins having a difference in glass transition temperature" holds true for "two resins having a difference in melting temperature" and "amorphous resins and crystalline resin having differences in glass transition temperature and melting temperature" in some cases.

The glass transition temperature can be controlled principally on the basis of the density of the rigid unit in the principal chain of the resin, such as an aromatic ring or a cyclohexane ring. In particular, in the case where the density of a methylene group, ethylene group, oxyethylene group, or another group in the principal chain is high, the glass transition temperature is low; in the case where the principal chain has a lot of aromatic rings and cyclohexane rings, the glass transition temperature is high. In addition, an increase in the density of the side chains such as an aliphatic group leads to a decrease in the glass transition temperature. In view of this mechanism, resins having various glass transition temperatures are produced.

Likewise, the melting temperature can be controlled on the basis of the density of the rigid unit.

In the case where the two resins are two amorphous resins having a difference in glass transition temperature in the following description, the one having a higher glass transition temperature is referred to as "high Tg resin", and the one having a lower glass transition temperature is referred to as "low Tg resin".

In the case where the two resins are two amorphous resins having a difference in melting temperature in the following description, the one having a higher melting temperature is referred to as "high melting point resin", and the one having a lower melting temperature is referred to as "low melting point resin".

In the case where the two resins are an amorphous resin and crystalline resin having differences in glass transition temperature and melting temperature in the following description, the one having a glass transition temperature higher than its melting temperature is referred to as "high Tg resin" and "low melting point resin", and the one having a glass transition temperature lower than its melting temperature is referred to as "low Tg resin" and "high melting point resin".

In the case where the pressure-plastic toner used in the first exemplary embodiment contains a high Tg resin and a low Tg resin, a suitable example thereof is a toner that can be in a phase-separated structure that is likely to exhibit plastic behavior on the application of pressure. Specific examples of such a toner include a toner that contains a mixture containing both the high Tg resin and the low Tg resin, a toner that contains a resin in which the high Tg resin and the low Tg resin form a sea-island structure, and a toner that contains resin particles in which the high Tg resin and the low Tg resin form a core-shell structure.

Examples in which the pressure-plastic toner used in the first exemplary embodiment contains the high melting point resin and the low melting point resin, examples in which it contains the high Tg resin and the low melting point resin, and examples in which it contains the low Tg resin and the high melting point resin are the same as the above-mentioned examples in which it contains the high Tg resin and the low Tg resin except that the types of resins to be used are changed.

An example of the pressure-plastic toner used in the first exemplary embodiment will now be described further in detail with reference to an example in which the high Tg resin and the low Tg resin are used.

Examples of the mixture containing both the high Tg resin and the low Tg resin include dispersion liquids of resin particles that are mixtures of a dispersion liquid of resin particles in which high Tg resin particles have been dispersed and a dispersion liquid of resin particles in which low Tg resin particles have been dispersed, powder that is a mixture of powder containing the high Tg resin and powder containing the low Tg resin, and solids that are mixtures of melted solid containing the high Tg resin and melted solid containing the low Tg resin.

The resin in which the high Tg resin and the low Tg resin are in a sea-island structure has a phase-separated structure in which the island phase is in the sea phase. Such a resin being in the sea-island structure may have a structure in which the high Tg resin is the sea phase and the low Tg resin is the island phase or a structure in which the high Tg resin is the island phase and the low Tg resin is the sea phase; it is suitable that the high Tg resin be the sea phase and that the low Tg resin be the island phase.

The sea-island structure in the resin contained in the toner is analyzed as follows. The toner is embedded into an epoxy resin, and then a slice is cut out of it with a diamond knife or another device. The slice is dyed with osmium tetraoxide in a desiccator, and the dyed slice is observed with a transmission electron microscope to analyze the structure of the resin. The sea phase and island phase of the sea-island structure are distinguished from each other on the basis of a difference in the concentration of color due to the degree of the dying with osmium tetraoxide.

The length of the island phase is suitably 500 nm or less. In the case where the high Tg resin is the sea phase and where the low Tg resin is the island phase, the low Tg resin phase as the island phase is suitably finely distributed. In this case, the length of the island phase is preferably 500 nm or less, more preferably from 5 nm to 500 nm, further preferably from 50 nm to 400 nm, and especially preferably from 100 nm to 300 nm. The island phase having a length of 500 nm or less enables the toner to easily exhibit sufficient pressure-plastic behavior, and the toner is therefore easy to be fixed in pressure fixing. The island phase having a length of 5 nm or more enables easy formation of a good sea-island structure without the high Tg resin and the low Tg resin being melted and mixed, which reduces the occurrence of blocking that results from plasticization even at normal temperature in a state in which pressure is not applied.

The length of the island phase is determined as follows. The toner is embedded into an epoxy resin, and then a slice is cut out of it with a diamond knife or another device. The slice is observed with a transmission electron microscope. Arbitrary 100 island phases observed in the slice are analyzed with a LUZEX image analyzer to determine the average length, and the length of the island phase is calculated from this average.

The proportion of the mass of the resin as the island phase to the mass of the resin as the sea phase is suitably 0.25 or more.

In the case where the high Tg resin is the sea phase and where the low Tg resin is the island phase, for instance, the proportion of the mass of the low Tg resin to the mass of the high Tg resin is preferably 0.3 or more, more preferably 0.4 or more, and further preferably 0.5 or more in order to enable adequate pressure-plastic behavior.

The proportion of the mass of the low Tg resin to the mass of the high Tg resin is suitably less than 1.5. At a proportion of less than 1.5, plasticization at normal temperature is less likely to occur.

The resin used for forming the sea-island structure is, for example, properly an addition-polymerization resin or a polycondensation resin.

The resin particles in which the high Tg resin and the low Tg resin form a core-shell structure are resin particles each having a core (core particle) and a coating layer that coats the core (shell layer).

A suitable example of the baroplastic is a resin that is an aggregate of resin particles in which the high Tg resin and the low Tg resin form the core-shell structure.

The core may be the high Tg resin, and the coating layer may be the low Tg resin; alternatively, the core may be the low Tg resin, and the coating layer may be the high Tg resin. It is suitable that the coating layer be the high Tg resin and that the core be the low Tg resin.

The diameter of the core is preferably from 10 nm to 200 nm, and more preferably from 20 nm to 150 nm. The thickness of the coating layer is preferably from 10 nm to 100 nm, and also preferably from 20 nm to 80 nm.

The core-shell structure is observed as follows. The toner is embedded into an epoxy resin, and then a slice is cut out of it with a diamond knife or another device. The slice is observed with a transmission electron microscope to determine the structure of the resin particles.

The resin used for forming the core-shell structure is, for instance, properly an addition-polymerization resin or a polycondensation resin.

In particular, the high Tg resin used in the sea-island structure or the core-shell structure is preferably a resin selected from the group consisting of a polyester resin, an acrylic resin, and a styrene-acrylic resin; and more preferably a styrene-acrylic resin in view of pressure-fixability and removability. The low Tg resin used in the sea-island structure or the core-shell structure is preferably a resin selected from the group consisting of a polyester resin and an acrylic resin, more preferably an acrylic resin, further preferably a resin selected from the group consisting of a homopolymer and copolymer of n-butylacrylate and a homopolymer and copolymer of 2-ethylhexyl acrylate, and especially preferably a homopolymer of n-butylacrylate or a homopolymer of 2-ethylhexyl acrylate in view of pressure-fixability and removability.

Second Example

The pressure-plastic toner used in the first exemplary embodiment suitably contains a resin that has two glass transition temperatures per molecule in view of easy occurrence of plastic behavior on application of pressure. In the case where the pressure-plastic toner used in the first exemplary embodiment contains such a resin, the toner is likely to have a phase-separated structure. Hence, the toner is likely to have a fluidity under application of pressure of a predetermined degree or more, and excellent fixability are therefore easily produced.

In the resin having two glass transition temperatures per molecule, the difference between the two glass transition temperatures is preferably approximately 30° C. or more, and more preferably 50° C. or more because such a difference enables the toner to be easily fixed at reduced pressure.

The resin having two glass transition temperatures per molecule is a block copolymer or graft copolymer of resins having a difference in glass transition temperature. In this case, the segment derived from a resin having a higher glass transition temperature is referred to as "high Tg segment", and the segment derived from a resin having a lower glass transition temperature is referred to as "low Tg segment".

The proportion of the high Tg segment in the resin is properly approximately from 5 mass % to 70 mass %, and preferably from 10 mass % to 60 mass %. In the case where the proportion of the high Tg segment is approximately from 5 mass % to 70 mass %, the fixing is easily performed at reduced pressure, and the fixability of an image is less likely to be impaired.

The resin has a glass transition temperature of preferably approximately 40° C. or more, more preferably 45° C. or more, and further preferably 50° C. or more. At a glass transition temperature of approximately 40° C. or more, the toner is likely to have an excellent storage stability.

In the block copolymer, the constitutional segments may be in any connection provided that the toner exhibits plastic behavior on application of pressure.

When the high Tg segment is A and the low Tg segment is B, examples of the structure of the block copolymer include AB, ABA, BAB, (AB)n, (AB)nA, and B(AB)n.

The phase-separated structure of the block copolymer can be in the most thermodynamically stable form depending on the types and molecular weights of the constitutional segments. In general, in a copolymer composed of a C segment and a D segment, it depends only on a C/D composition ratio regardless of the form of the connection thereof. The most thermodynamically stable form of the phase-separated structure systematically changes from a structure in which C is a spherical domain and D is the matrix (C: sphere, D: matrix) (sea-island structure) through a structure in which C is a cylindrical domain and D is the matrix (cylinder), a structure in which C and D are nested (gyroid), a structure with a C/D alternate layer (lamellar), a structure in which D is a cylindrical domain and C is the matrix (cylinder), and a structure in which D and C are nested (gyroid) to a structure in which D is a spherical domain and C is the matrix (D: sphere, C: matrix) (sea-island structure) as the C/D ratio increases.

In the case where the toner is produced by a wet process, however, the state of the phase separation is optionally controlled on the basis of the type of a solvent to be used and a drying rate. For instance, even when the C/D ratio is large and D and C are thermodynamically the sphere and the matrix, respectively, using a solvent that is a good solvent for D but a poor solvent for C enables production of a structure in which C and D are the sphere and the matrix, respectively.

A good solvent for both C and D can be used and then promptly removed to produce a phase-separated structure frozen in a state of spinodal decomposition (modulated structure). In addition, when a polymer that is compatible with only D is added to the copolymer which has a large C/D ratio and in which D and C are thermodynamically the sphere and the matrix, respectively, a phase-separated structure in which C is the sphere and in which D and the polymer compatible with only D are the matrix can be produced.

The size of a repeating unit of the phase-separated structure of the block copolymer increases as the molecular weight of the block copolymer increases. The weight average molecular weight of the block copolymer is properly from 3,000 to 500,000, preferably from 5,000 to 400,000, and more preferably from 6,000 to 300,000.

The structure in which C is the sphere and in which D is the matrix and the structure in which D is the sphere and in which C is the matrix refer to resin particles in which a block copolymer having the high Tg segment and the low Tg segment is in a sea-island structure or a composition containing such resin particles. The sea-island structure is the same as the above-mentioned sea-island structure of the high Tg resin and the low Tg resin.

The block copolymer or graft copolymer having a high Tg segment and a low Tg segment may be in the form of resin particles having a core-shell structure. The core-shell structure is the same as the above-mentioned core-shell structure of the high Tg resin and the low Tg resin.

An example of a technique for producing the resin particles in which the block copolymer or the graft copolymer has a core-shell structure is as follows: aggregated particles that serve as a core are prepared by an emulsion aggregation method, and a monomer is polymerized on the surfaces of the aggregated particles to form a shell layer.

Such a block copolymer or graft polymer may be synthesized by any of appropriate techniques disclosed in literatures such as "The fourth Series of Experimental Chemistry. 28 *Polymer Synthesis;* Maruzen Publishing Co., Ltd.; 1992", *"Macromonomers: Chemistry and Applications;* IPC Press Inc.; 1990", *"Kohbunshi no Aiyouka to Hyouka Gijutsu;* Technical Information Institute Co., Ltd.; 1992", "Kohbunshi Shin Sozai One Point. 12 *Polymer Alloy;* Kyoritsu Shuppan Co., Ltd.; 1988", "Angew. Macromol. Chem; 143; 1986; pp. 1-9", "*Journal of the Adhesion Society of Japan;* 26; 1990; pp. 112-118", "*Macromolecules;* 28; 1995; pp. 4893-4898", "J. Am. *Chem. Soc.;* 111; 1989; pp. 7641-7643", and Japanese Unexamined Patent Application Publication No. 6-83077.

The resin used for synthesizing the block copolymer or the graft copolymer may be, for example, properly an addition-polymerization resin or a polycondensation resin.

Temperature Characteristics of Resin

The "crystallinity" of a resin refers to that the resin does not have a stepwise change in the amount of heat absorption but have a definite endothermic peak in the differential scanning calorimetry. Specifically, it refers to that the half-value width of the endothermic peak in the measurement at a rate of temperature increase of 10 (° C./min) is within 10° C. The "amorphous properties" of a resin refers to that the half-value width of the endothermic peak exceeds 10° C., that a stepwise change in the amount of heat absorption is exhibited, or that definite endothermic peak is not observed.

The glass transition temperature of the resin is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics". The melting temperature of the resin is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The measurement of the glass transition temperature of the toner containing the high Tg resin and the low Tg resin will be described for each example of the toner.

In an example of the toner containing a mixture that contains both the high Tg resin and the low Tg resin, the glass transition temperatures of the high Tg resin and the low Tg resin before being mixed are measured.

In an example of the toner containing a resin in which the high Tg resin and the low Tg resin form a sea-island structure, the glass transition temperatures of the high Tg resin and the low Tg resin before preparation of the resin having the sea-island structure are measured.

In an example in which the toner contains resin particles in which the high Tg resin and the low Tg resin form a core-shell structure (suitably aggregate of the resin particles in which the high Tg resin and the low Tg resin form a core-shell structure) and in which the resin particles are prepared by an emulsion aggregation method, the glass transition temperatures of the high Tg resin and low Tg resin before the preparation of the resin particles are measured.

The melting temperature of a toner containing the high melting temperature resin and the low melting temperature resin can be measured as in the measurement of the glass transition temperature of the toner containing the high Tg resin and the low Tg resin except that the glass transition temperature is changed to the melting temperature. The glass transition temperature and melting temperature of a toner in which other resins are used in combination, such as toner containing the high Tg resin and the low melting temperature resin, can be also measured as in the above-mentioned measurement.

In the case where the toner contains a block copolymer or graft copolymer having the high Tg segment and the low Tg segment, the block copolymer or graft copolymer contained in the toner is subjected to differential scanning calorimetry. From the obtained DSC curve, the glass transition temperature derived from the high Tg segment and the glass transition temperature derived from the low Tg segment in the molecule of the block copolymer or graft copolymer are determined.

The glass transition temperature or melting temperature of another example of the toner containing the block copolymer or the graft copolymer can be measured as in such measurement.

Resin

Resins suitably used as a material of the baroplastic or used in the shell layer of particles having a core-shell structure, which will be described later, will now be described.

The pressure-plastic toner used in the first exemplary embodiment may contain any of the resins described below as a resin other than the baroplastic; however, the amount thereof is suitably less than the baroplastic content.

Examples of the resin include addition-polymerization resins and polycondensation resins.

The addition-polymerization resins are polymers of monomers having an ethylenically unsaturated double bond.

Examples of the monomers (monomers having an ethylenically unsaturated double bond) contained in the addition-polymerization resins include styrenes such as styrene, parachlorostyrene, and α-methylstyrene; (meth)acrylates such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate, and 2-ethylhexyl methacrylate; (meth)acrylonitriles such as acrylonitrile and methacrylonitrile; ethylenically unsaturated carboxylic acids such as acrylic acid, methacrylic acid, and crotonic acid; vinyl ethers such as vinyl methyl ether and vinyl isobutyl ether; vinyl ketones such as vinyl methyl ketone, vinyl ethyl ketone, and vinyl isopropenyl ketone; olefins such as isoprene, butene, and butadiene; and β-carboxyethyl acrylate. A homopolymer produced by polymerization of one of these monomers, a copolymer produced by copolymerization of two or more of these monomers, or a mixture thereof may be used.

The addition-polymerization resin may optionally contain an acidic polar group, a basic polar group, or an alcoholic hydroxyl group. Examples of the acidic polar group include a carboxyl group, a sulfonic acid group, and an acid anhydride.

Examples of monomers used for incorporating the acidic polar group into the addition-polymerization resin include α, β-ethylenically unsaturated compounds having a carboxy group or a sulfonic acid group. In particular, suitable monomers are acrylic acid, methacrylic acid, fumaric acid, maleic acid, itaconic acid, cinnamic acid, sulfonated styrene, or allyl sulfosuccinic acid.

Examples of the basic polar group include an amino group, an amide group, and hydrazide group.

Examples of monomers used for incorporating the basic polar group into the addition-polymerization resin include monomers having a nitrogen atom (also referred to as "nitrogen-containing monomer"). Among the nitrogen-containing monomers, a (meth)acrylic amide compound, a (meth)acrylic hydrazide compound, or an aminoalkyl (meth) acrylate compound is suitable.

The terms "(meth)acrylic acid" and similar description are simple description that comprehends the structures of both methacrylic acid and acrylic acid. The same holds true for the following description.

Examples of the (meth)acrylic amide compound include acrylic amide, methacrylic amide, acrylic methylamide, methacrylic methylamide, acrylic dimethylamide, acrylic diethylamide, acrylic phenylamide, and acrylic benzylamide.

Examples of the (meth)acrylic hydrazide compound include acrylic hydrazide, methacrylic hydrazide, acrylic methylhydrazide, methacrylic methylhydrazide, acrylic dimethylhydrazide, and acrylic phenylhydrazide.

The aminoalkyl (meth)acrylate compound may be a monoalkylaminoalkyl (meth)acrylate compound or a dialkylaminoalkyl (meth)acrylate compound. Examples of the aminoalkyl (meth)acrylate compound include 2-aminoethyl acrylate, 2-aminoethyl methacrylate, and 2-(diethylamino) ethyl (meth) acrylate.

Suitable examples of a monomer for forming the alcoholic hydroxyl group include hydroxy (meth)acrylates; and specific examples thereof include 2-hydroxyethyl (meth) acrylate, hydroxypropyl (meth)acrylate, and hydroxybutyl (meth)acrylate.

A chain transfer agent may be used in the polymerization of the addition-polymerization resin.

Examples of the chain transfer agent include, but are not limited to, compounds having a thiol component. Examples of the compounds having a thiol component include mercaptans. Suitable examples of the mercaptans include alkyl mercaptans such as hexyl mercaptan, heptyl mercaptan, octyl mercaptan, nonyl mercaptan, decyl mercaptan, and dodecyl mercaptan.

A crosslinking agent may be added to the addition-polymerization resin to produce a crosslinked resin. Examples of the crosslinking agent include polyfunctional monomers each having two or more ethylenically unsaturated groups in the molecule thereof.

Examples of the polyfunctional monomers include aromatic polyvinyl compounds such as divinylbenzene and divinylnaphthalene; polyvinyl esters of aromatic polyvalent carboxylic acid, such as divinyl phthalate, divinyl isophthalate, divinyl terephthalate, divinyl homophthalate, divinyl/trivinyl trimesate, divinyl naphthalenedicarboxylate, and divinyl biphenylcarboxylate; divinyl esters of nitrogen-containing aromatic compounds, such as divinyl pyridinedicarboxylate; vinyl esters of unsaturated heterocyclic compounds of carboxylic acid, such as vinyl pyromucate, vinyl furancarboxylate, vinyl pyrrole-2-carboxylate, and vinyl thiophenecarboxylate; (meth)acrylic acid esters of linear polyols, such as butanediol methacrylate, hexanediol acrylate, octanediol methacrylate, decanediol acrylate, and dodecanediol methacrylate; (meth)acrylic esters of branched and substituted polyol, such as neopentyl glycol dimethacrylate and 2-hydroxy-1,3-diacryloxypropane; polyethylene glycol di(meth)acrylates; polypropylene polyethylene glycol di(meth)acrylates; and polyvinyl esters of polycarboxylic acids, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioate, and divinyl brassylate. These crosslinking agents may be used alone or in combination.

Among the crosslinking agents, (meth)acrylic acid esters of linear polyols, such as butanediol methacrylate, hexanediol acrylate, octanediol methacrylate, decanediol acrylate, and dodecanediol methacrylate; (meth)acrylic acid esters of branched and substituted polyols, such as neopentyl glycol dimethacrylate and 2-hydroxy-1,3-diacryloxypropane; polyethylene glycol di(meth)acrylates; and polypropylene polyethylene glycol di(meth)acrylates are suitably used.

The amount of the crosslinking agent is preferably approximately from 0.05 mass % to 5 mass %, and more preferably from 0.1 mass % to 1.0 mass % relative to the total amount of the monomers contained in the addition-polymerization resin.

The addition-polymerization resin may be produced through radical polymerization with the aid of a radical polymerization initiator. The radical polymerization initiator is not particularly limited, and any of known radical polymerization initiators may be used.

The amount of the radical polymerization initiator to be used is preferably from 0.01 mass % to 15 mass %, and more preferably from 0.1 mass % to 10 mass % relative to the total amount of the monomers contained in the addition-polymerization resin.

The weight average molecular weight of the addition-polymerization resin is preferably approximately from 1,500 to 60,000, and more preferably from 3,000 to 40,000.

The weight average molecular weight (Mw) and the number average molecular weight (Mn) are measured by gel permeation chromatography (GPC). The measurement of the molecular weight by GPC involves using a measurement apparatus that is GPC•HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

Examples of the polycondensation resin include polyester resins. The polyester resins may be crystalline or amorphous.

Examples of monomers contained in the polyester resins include polycarboxylic acids each containing two or more carboxyl groups per molecule, polyols each containing two or more hydroxyl groups per molecule, and hydroxy carboxylic acids.

Examples of dicarboxylic acid among the polycarboxylic acids used for producing the crystalline polyester resins include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and 1,4-cyclohexanedicarboxylic acid. These dicarboxylic acids may be used alone or in combination.

Examples of polycarboxylic acids other than the dicarboxylic acids include trimellitic acid, pyromellitic acid, naphthalenetricarboxylic acid, naphthalenetetracarboxylic acid, pyrenetricarboxylic acid, and pyrenetetracarboxylic acid.

In addition, acid anhydrides, mixed acid anhydrides, acid chlorides, or esters derived from the carboxy groups of these carboxylic acids may be used. The polycarboxylic acids other than the dicarboxylic acids may be used alone or in combination. These polycarboxylic acids may be used alone or in combination.

Examples of the polyols used for producing the crystalline polyester resins include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol, polypropylene glycol, polytetramethylene glycol, bisphenol A, bisphenol Z, hydrogenated bisphenol A, cyclohexanedimethanol, and alkylene oxide adducts of these alcohols. These polyols may be used alone or in combination.

The polycarboxylic acids and the polyols are used in combination for polycondensation to produce the intended crystalline polyester resin.

Examples of the crystalline polyester resin include polyester resins produced by polycondensation of 1,9-nonanediol and 1,10-decanedicarboxylic acid, polyester resins produced by polycondensation of cyclohexanediol and adipic acid, polyester resins produced by polycondensation of 1,6-hexanediol and sebacic acid, polyester resins produced by polycondensation of ethylene glycol and succinic acid, polyester resins produced by polycondensation of ethylene glycol and sebacic acid, and polyester resins produced by polycondensation of 1,4-butanediol and succinic acid.

One of the polycarboxylic acids and one of the polyols may be used, one of either the polycarboxylic acids or the polyols and two or more of the other may be used, or two or more of the polycarboxylic acids and two or more of the polyols may be used. In the case where a hydroxycarboxylic acid is used as the monomer, one of hydroxycarboxylic acids may be used, or two or more thereof may be used in combination. The hydroxycarboxylic acid may also be used in combination with a polycarboxylic acid or a polyol.

Examples of dicarboxylic acid among the polycarboxylic acids used for producing the amorphous polyester resin include phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid.

Examples of polycarboxylic acids other than the dicarboxylic acids include trimellitic acid, pyromellitic acid, naphthalenetricarboxylic acid, naphthalenetetracarboxylic acid, pyrenetricarboxylic acid, and pyrenetetracarboxylic acid. Acid anhydrides, acid chlorides, or esters derived from the carboxy groups of these carboxylic acids may be used. These polycarboxylic acids may be used alone or in combination.

Among these, terephthalic acid or a lower ester thereof, diphenylacetic acid, and 1,4-cyclohexanedicarboxylic acid are suitable. The term "lower esters" refers to esters of an aliphatic alcohol having from 1 to 8 carbon atoms.

Examples of the polyols used for producing the amorphous polyester resin include the above-mentioned polyols. Among the polyols, polytetramethylene glycol, bisphenol A, bisphenol Z, hydrogenated bisphenol A, cyclohexanedimethanol, and alkylene oxide adducts of these alcohols are particularly suitable. These polyols may be used alone or in combination.

The above-mentioned polycondensable monomers can be used in combination to easily produce the amorphous resin or the crystalline resin.

In order to prepare one polycondensation resin, one of the polcarboxylic acids and one of the polyols may be used, one of either the polycarboxylic acids or the polyols and two or more of the other may be used, or two or more of the polycarboxylic acids and two or more of the polyols may be used. In the case where a hydroxycarboxylic acid is used to prepare one polycondensation resin, one of hydroxycarboxylic acids may be used, or two or more thereof may be used in combination. The hydroxycarboxylic acid may also be used in combination with a polycarboxylic acid or a polyol.

The weight average molecular weight of the polycondensation resin is preferably from 1,500 to 60,000, and more preferably from 3,000 to 40,000. In addition, the polycondensation resin may have branched or a bridged structure on the basis of selection of the carboxylic acid value and alcohol valence of a monomer.

Masking Agent

The pressure-plastic toner used in the first exemplary embodiment suitably contains a masking agent in terms of masking properties; however, in the case where a thermoplastic toner having masking properties is used in combination, the pressure-plastic toner does not need to contain the masking agent.

The thermoplastic toner used in the first exemplary embodiment and having masking properties suitably contains a masking agent in terms of masking properties.

The masking agent is preferably a colorant, more preferably a pigment, and further preferably a metallic pigment in terms of masking properties.

The colorant that is usable in the first exemplary embodiment can be any of colorants that can be generally used as colorants in toner; in order to enhance the masking properties and to give equivalent texture to masking part in general image formation, highly bright particles are suitably employed or used in combination.

Examples of the highly bright particles include metallic pigments such as aluminum, brass, bronze, nickel, stainless steel, and zinc; white pigments such as titanium oxide, barium sulfate, and calcium carbonate; covered thin inorganic crystalline matrix, such as mica covered with yellow iron oxide, sheet silicate, and silicate of sheet aluminum; and planar monocrystalline titanium oxide, basic carbonate, bismuth oxychloride, natural guanine, flaked glass powder, and flaked glass powder subjected to deposition of metal.

In view of masking properties, use of a black pigment is suitable. An example of the black pigment is carbon black.

In particular, metallic pigments are preferred, and an aluminum pigment is more preferred. The aluminum pigment suitably has a flat shape or a scaly shape.

The masking pressure toner used in the first exemplary embodiment may contain any of known colorants not only to produce masking properties but also to form the masking layer of a scratchable image in a predetermined color.

Such masking agents may be used alone or in combination.

The masking agent may be optionally a surface-treated colorant or may be used in combination with a dispersant. Different types of masking agents may be used in combination.

The dispersant can be any of known dispersants used for dispersing pigments.

The amount of the masking agent is preferably from 1 mass % to 30 mass %, and more preferably from 3 mass % to 15 mass % relative to the mass of the whole toner.

Release Agent

The pressure-plastic toner and thermoplastic toner used in the first exemplary embodiment may contain a release agent.

Examples of the release gent include, but are not limited to, hydrocarbon waxes; natural waxes such as a carnauba wax, a rice bran wax, and a candelilla wax; synthetic or mineral/petroleum waxes such as a montan wax; and ester waxes such as a fatty acid ester and a montanic acid ester.

The melting temperature of the release agent is preferably from 50° C. to 110° C., and more preferably 60° C. to 100° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The amount of the release agent is, for example, preferably from 1 mass % to 20 mass %, and more preferably from 5 mass % to 15 mass % relative to the mass of the whole toner particles.

Other Additives

The pressure-plastic toner and thermoplastic toner used in the first exemplary embodiment may contain other additives. Such other additives are contained in the toner particles as internal additives.

Examples of such other additives include magnetic materials, charge-controlling agent, and inorganic powder. These additives can be any of materials known as internal additives contained in toner used for developing electrostatic charge images.

Properties of Toner Particles

The toner particles may have a monolayer structure or may have a core-shell structure including a core (core particle) and a coating layer (shell layer) that covers the core.

The toner particles having a core-shell structure, for instance, properly include a core containing at least one selected from the group consisting of a binder resin and optionally a colorant, a release agent, and other additives and a coating layer containing a binder resin.

The baroplastic may exist only in either the core or the shell or in both the core and the shell. It is suitable that the baroplastic exist only in the core or in both the core and the shell.

The volume average particle size ($D_{50v}$) of the toner particles is preferably from 2 μm to 10 μm, and more preferably from 4 μm to 8 μm.

Average particle size of the toner particles and the index of the particle size distribution thereof are measured with Coulter Multisizer II (manufactured by Beckman Coulter, Inc.) and an electrolyte that is ISOTON-II (manufactured by Beckman Coulter, Inc.).

In the measurement, from 0.5 mg to 50 mg of a measurement sample is added to 2 ml of an aqueous solution of a 5-mass % surfactant (suitably sodium alkylbenzene sulfonate) as a dispersant. This product is added to from 100 ml to 150 ml of the electrolyte.

The electrolyte suspended with the sample is subjected to dispersion for one minute with an ultrasonic disperser and then subjected to the measurement of the particle size distribution of particles having a particle size ranging from 2 μm to 60 μm using Coulter Multisizer II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size $D_{16v}$ and a number particle size $D_{16p}$, while the particle size for a cumulative percentage of 50% is defined as a volume average particle size $D_{50v}$ and a number average particle size $D_{50p}$ . Furthermore, the particle size for a cumulative percentage of 84% is defined as a volume particle size $D_{84v}$ and a number particle size $D_{84p}$).

From these particle sizes, the index of the volume average particle size distribution (GSDv) is calculated as $(D_{84v}/D_{16v})^{1/2}$ while the index of the number average particle size distribution (GSDp) is calculated as $(D_{84p}/D_{16p})^{1/2}$.

The shape factor SF1 of the toner particles is preferably from 110 to 150, and more preferably from 120 to 140.

The shape factor SF1 is given from the following equation.

$$SF1=(ML^2/A)\times(\pi/4)\times100$$

In this equation, ML represents the absolute maximum length of toner particles, and A represents the projected area of toner particles.

Specifically, the shape factor SF1 is converted into numerals principally by analyzing a microscopic image or a scanning electron microscopic (SEM) image with an image analyzer and calculated as follows. In particular, the optical microscopic image of particles scattered on the surface of a glass slide is input to an image analyzer LUZEX through a video camera to measure the maximum lengths and projected areas of 100 particles, the value of SF1 is calculated from the above equation, and the average value thereof is obtained.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as an external additive are suitably hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is suitably from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high molecular weight fluorine material).

The amount of the external additive to be used is, for example, preferably from 0.01 mass % to 5 mass %, and more preferably from 0.01 mass % to 2.0 mass % relative to the mass of the whole toner particles.

Production of Pressure-plastic Toner

The pressure-plastic toner used in the first exemplary embodiment (masking pressure toner) can be produced by any method and may be produced by known dry processes, such as a kneading and grinding method, or known wet processes such as an emulsion aggregation method, a dissolution suspension method, a suspension polymerization method, and a P×P method. Among these, so-called chemical processes, such as an emulsion aggregation method, a dissolution suspension method, a suspension polymerization method, and a P×P method, are preferred in terms of easily controlling the structure, average particle size, and particle size distribution of the toner; and an emulsion aggregation method and a dissolution suspension method are more preferred.

An emulsion aggregation method and a dissolution suspension method will now be described as representative production methods.

Emulsion Aggregation Method

The emulsion aggregation method in the first exemplary embodiment may include an emulsifying process for emulsifying raw materials constituting the toner into resin particles (emulsified particles), an aggregation process for forming aggregate containing the resin particles, and a coalescing process for coalescing the aggregate.

Emulsifying Process

A dispersion liquid of resin particles may be, for example, prepared by applying a shearing force with a disperser to a solution that is a mixture of an aqueous medium and a binder resin. In this case, the particles may be formed by reducing the viscosity of the resin component through heating. In addition, a dispersant may be used to stabilize the dispersed resin particles.

Furthermore, when the resin is oily and dissolved in a solvent having a relatively low solubility in water, the resin is dissolved in such a solvent and particle-dispersed in water along with a dispersant and a polymer electrolyte, and then the solvent is evaporated by heating or reducing pressure, thereby preparing the dispersion liquid of resin particles.

In the first exemplary embodiment, the above-mentioned baroplastic resin is suitably used as a binder resin in the emulsifying process.

Examples of the aqueous medium include water, such as distilled water and ion exchanged water, and alcohols; among these, water is suitable.

Examples of the dispersant used in the emulsifying process include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants including anionic surfactants such as sodium dodecylbenzene sulfonate, sodium octadecyl sulfate, sodium oleate, sodium laurate, and potassium stearate, cationic surfactants such as lauryl amine acetate, stearyl amine acetate, and lauryl trimethyl ammonium chloride, zwitterionic surfactants such as lauryl dimethyl amine oxide, and nonionic surfactants such as polyoxyethylene alkyl ether, polyoxyethylene alkyl phenyl ether, and polyoxyethylene alkyl amine; and inorganic salts such as tricalcium phosphate, aluminum hydroxide, calcium sulfate, calcium carbonate, and barium carbonate.

Examples of the disperser used in the preparation of the emulsion include a homogenizer, a homomixer, a pressure kneader, an extruder, and a media disperser. The average particle size (volume average particle size) of the resin particles is preferably 1.0 μm or less, more preferably from 60 nm to 300 nm, and further preferably from 150 nm to 250 nm. At a particle size of less than 60 nm, the resin particles are stable in the dispersion liquid, which makes it difficult to aggregate the resin particles in some cases. At a particle size of greater than 1.0 μm, aggregability of the resin particles is improved, and thus the preparation of the toner particles become easy; however, the particle size distribution of the toner particles becomes broad in some cases.

In the preparation of a dispersion liquid of a release agent, a release agent is dispersed in water along with an ionic surfactant or a polymer electrolyte, such as a polymer acid or a polymer base, and then heated to a temperature greater than or equal to the melting temperature of the release agent as well as being dispersed with a homogenizer or pressure-discharging disperser that serves to apply a strong shearing force. Through this process, a dispersion liquid of a release agent is produced. In the dispersion treatment, inorganic compounds such as polyaluminum chloride may be added to the dispersion liquid. Suitable examples of the inorganic compounds include polyaluminum chloride, aluminum sulfate, highly basic polyaluminum chloride (BAC), polyaluminum hydroxide, and aluminum chloride. Among these, polyaluminum chloride and aluminum sulfate may be used. The dispersion liquid of a release agent is used in the emulsion aggregation method but may also be used in production of toner by the suspension polymerization method.

The dispersion treatment enables production of the dispersion liquid of a release agent that contains release agent particles having a volume average particle size of 1 μm or less. A further suitable volume average particle size of the release agent particles is from 100 nm to 500 nm.

At a volume average particle size of 100 nm or more, the release agent components are generally likely to be incorporated in the toner, although this is affected by the characteristics of the binder resin that is to be used. At a volume average particle size of 500 nm or less, the release agent can be well dispersed in the toner.

A dispersion liquid of a colorant can be prepared by any of known dispersion techniques; for example, general dispersers can be used without limitation, such as rotary shearing homogenizers or those having media, e.g., a ball mill, a sand mill, a DYNO mill, and an ULTIMIZER. The colorant is dispersed along with an ionic surfactant or a polyelectrolyte, such as a polymer acid or a polymer base, in water. The volume average particle size of the colorant particles dispersed in water may be 1 μm or less, and a volume average particle size ranging from 80 nm to 500 nm is suitable because it does not impair aggregability and enables the colorant to be well dispersed in the toner.

Aggregation Process

In the aggregation process, a liquid mixture of the dispersion liquid of resin particles, a remover (or dispersion liquid thereof), the dispersion liquid of a colorant, and the dispersion liquid of a release agent is heated at temperature less than or equal to the glass transition temperature of the resin particles to aggregate particles. The aggregated particles are formed by adjusting the pH of the liquid mixture to be acidic under stirring in many cases. The pH is suitably from 2 to 7. In this case, use of a coagulant is also effective.

In the aggregation process, the dispersion liquid of a release agent and a variety of other dispersion liquids, such as the dispersion liquid of resin particles, may be added and mixed at once or in two or more stages.

The coagulant can be suitably a surfactant having an opposite polarity to the surfactant used as the dispersant, an inorganic metal salt, or a di- or higher valent metal complex. In particular, the metal complex is especially suitable because use of the metal complex enables a reduction in the amount of the surfactant, which is to be used, and an improvement in charging properties.

Particularly suitable examples of the inorganic metal salt include aluminum salts and polymers thereof. In order to obtain a narrower particle size distribution, a divalent inorganic metal salt is more appropriate than a monovalent inorganic metal salt, a trivalent inorganic metal salt is more appropriate than a divalent inorganic metal salt, and a tetravalent inorganic metal salt is more appropriate than a trivalent inorganic metal salt. When inorganic metal salts having the same valence are compared, a polymer type of inorganic metal salt polymer is more appropriate.

In the first exemplary embodiment, a polymer of a tetravalent inorganic metal salt containing aluminum is suitably used in order to obtain a narrower particle size distribution.

Coalescing Process

In the coalescing process, the progress of the aggregation is stopped by increasing the pH of the suspension of the aggregated particles to be from 3 to 9 under stirring conditions based on the aggregation process. Then, heating is performed at a temperature greater than or equal to the glass transition temperature of the resin to coalesce the aggregated particles. The duration of the heating may be determined so that the aggregated particles are coalesced; it may be approximately from 0.5 hours to 10 hours.

After the coalescing, cooling is performed to obtain coalesced particles. In the cooling, crystallization may be promoted by decreasing a cooling rate in the vicinity of the glass transition temperature of the resin (the range of the glass transition temperature±10° C.), that is, by so-called slow cooling.

The coalesced particles are formed into toner particles through a solid-liquid separation process such as filtration, a cleaning process, and a drying process after the coalescing.

The drying process may be, for example, a process involving use of a flash dryer, and examples thereof include drying involving use of a flash jet dryer and a treatment with a fluid bed. In particular, in the case of the drying involving use of a flash jet dryer, the airflow temperature (inlet airflow temperature) is preferably set to be from 30° C. to 70° C. (more preferably from 40° C. to 60° C.).

External Addition Process

To the obtained toner particles, an external additive such as a fluidizer or an auxiliary agent may be added. The above-mentioned known particles can be used as the external additive.

The external additive may be added, for example, with a V-blender, a Henschel mixer, or a Loedige mixer and may be added in two or more stages. The above-mentioned components are externally added to the toner particles to obtain the toner that is the pressure-plastic toner used in the first exemplary embodiment.

Dissolution and Suspension Method

The dissolution and suspension method in the first exemplary embodiment may include an oil phase preparation process for preparing an oil phase by dissolving or dispersing toner components containing at least a binder resin in an organic solvent, a granulation process for suspending and granulating the oil phase component in an aqueous phase, and a solvent removal process for removing the solvent.

Oil Phase Preparation Process

In the dissolution and suspension method, an oil phase is first prepared by dissolving or dispersing the above-mentioned toner components containing at least a binder resin in an organic solvent.

In the first exemplary embodiment, the above-mentioned baroplastic is suitably used as the binder resin.

Although the type of the organic solvent to be used depends on the type of the binder resin, generally used are hydrocarbons such as toluene, xylene, and hexane; halogenated hydrocarbons such as methylene chloride, chloroform, and dichloroethane; alcohols or ethers such as ethanol, butanol, benzyl alcohol ether, and tetrahydrofuran; esters such as methyl acetate, ethyl acetate, butyl acetate, and isopropyl acetate; and ketones such as acetone, methyl ethyl ketone, diisobutyl ketone, cyclohexanone, and methylcyclohexane. These solvents need to dissolve the binder resin but do not need to dissolve the colorant to be optionally added and other additives. The mass ratio of the toner components used in the oil phase, such as the binder resin and the colorant, to the solvent is preferably from 10:90 to 80:20 in terms of easy granulation or a final toner yield.

In the first exemplary embodiment, a colorant may be dispersed in advance with the aid of a synergist and a dispersant to prepare a dispersion liquid of the colorant before preparation of the oil phase, and this dispersion liquid may be mixed with the binder resin or another material. In the preparation of the dispersion liquid of a colorant, the synergist and the dispersant are first allowed to adhere to the colorant. The adhesion to the colorant is performed with a general stirrer. Specifically, for example, a colorant, a synergist, and a dispersant are put into a container provided with a granular medium, such as an attritor, a ball mill, a sand mill, or a vibration mill; the container is maintained to be within a proper temperature, for instance, ranging from 20° C. to 160° C.; and the content is stirred. A granular medium that is suitably used is steel such as stainless steel or carbon steel, alumina, zirconia, or silica. The colorant is disaggregated with the stirrer, and subsequently dispersed until the average particle size thereof becomes preferably 0.5 μm or less, and more preferably 0.3 μm or less. Then, the synergist and the dispersant are allowed to adhere to the colorant by application of a load of stirring. This product is diluted with a solvent to yield the dispersion liquid of a colorant.

In the first exemplary embodiment, the materials are suitably dispersed again by high speed shearing or another process in the mixing of the dispersion liquid of a colorant with the binder resin or another material in order to avoid the aggregation of the colorant. The materials may be dispersed with a disperser provided with a high-speed shearing mechanism of a high-speed blade rotation type or a forcibly interval passing type, such as a homomixer, a homogenizer, a colloid mill, ULTRA-TURRAX, or CLEARMIX. In the preparation of the oil phase liquid, the colorant is preferably dispersed in the oil phase liquid to a particle size of preferably 1 μm or less, more preferably 0.5 μm or less, and further preferably 0.3 μm or less.

Granulation Process

These oil phase components are suspended and granulated so as to have a particle size necessary for an aqueous phase. The principal medium of the aqueous phase is water, and inorganic particles such as calcium carbonate or calcium phosphate may be used as the dispersant. In the first exemplary embodiment, the principal medium of the aqueous phase refers to a medium of which the content is 50 mass % or more relative to the mass of the whole solvent in the aqueous phase. The water content is preferably 80 mass % or more, and more preferably 90 mass % or more relative to the mass of the whole solvent in the aqueous phase. The upper limit thereof is not particularly limited, and the water content may be 100 mass %.

The dispersant (dispersion stabilizer) forms hydrophilic colloid and thus serves to disperse and stabilize droplets of the oil phase liquid. Examples of an inorganic dispersant include calcium carbonate, magnesium carbonate, barium carbonate, tricalcium phosphate, hydroxyapatite, silica diatomaceous earth, and clay. The particle size of the inorganic dispersant is preferably from 1 μm to 2 μm, and more preferably 0.1 μm or less. The inorganic dispersant is suitably used after being pulverized with a wet type disperser, such as a ball mill, a sand mill, or an attritor, to a necessary particle size. In the case where the particle size of the inorganic dispersant is 2 μm or less, the particle size distribution of the granulated toner particles is narrow, and this is suitable for a toner; thus, such a particle size is appropriate.

Specific examples of organic dispersants that may be used alone or in combination with the inorganic dispersant include gelatins and gelatin derivatives (for instance, acetylated gelatin, phthalated gelatin, and succinated gelatin), proteins such as albumin and casein, collodion, gum arabic, agar, alginic acid, cellulose derivatives (for instance, alkyl esters of carboxymethyl cellulose, hydroxy methyl cellulose, and carboxymethyl cellulose), and synthetic polymers (for instance, polyvinyl alcohol, polyvinyl pyrrolidone, polyacrylamide, polyacrylate, polymethacrylate, polymaleate, and polystyrenesulfonate). These organic dispersants may be used alone or in combination.

The dispersant is preferably used in an amount ranging from 0.001 mass % to 5 mass % relative to the total mass of the principal media of the aqueous phase.

The aqueous phase may be used in combination with a dispersion aid. The dispersion aid is suitably a surfactant, and examples thereof include ionic surfactants and nonionic surfactants. These dispersion aids may be used alone or in combination. The dispersion aid is preferably used in an amount ranging from 0.001 mass % to 5 mass % relative to the principal media of the aqueous phase.

Although the mixing ratio of the oil phase to the aqueous phase varies depending on the particle size of the final toner or the type of a production apparatus, the mixing ratio of the oil phase to the aqueous phase is suitably from 10/90 to 90/10 on a mass basis. The granulation of the oil phase in the aqueous phase is suitably performed under high speed shearing. Particularly in the case where the toner is formed so as to have a particle size ranging from 2 μm to 10 μm, it is appropriate that the type of a disperser with a high-speed shearing mechanism be carefully selected. In particular, use of an emulsifying disperser of a high-speed blade rotation type or a forcibly interval passing type is suitable, such as a homomixer, a homogenizer, a colloid mill, ULTRA-TURRAX, or CLEARMIX.

Solvent Removal Process

The solvent (medium) is removed in or after the granulation process. The solvent may be removed at normal temperature (for example, 25° C.) or under reduced pressure. In order to remove the solvent at normal temperature, the temperature that is lower than the boiling point of the solvent and that is determined in consideration of the Tg of the resin is suitably employed. When the temperature is greatly higher than the Tg of the resin, the toner may coalesce. Stirring is suitably performed normally at about 40° C. for 3 hours to 24 hours. In the case where pressure is reduced, the pressure is suitably reduced to be from 20 mmHg to 150 mmHg.

After the removal of the solvent, the resulting granulated product (slurry product) is suitably washed with an acid that makes the inorganic dispersant water-soluble, such as hydrochloric acid, nitric acid, formic acid, or acetic acid. The washing enables the inorganic dispersant remaining on the surfaces of the toner particles to be removed. Such granulated product treated with the acid may be washed again with alkaline water of, for example, sodium hydroxide. Although the surfaces of the toner particles have been insolubilized by being kept in an acidic atmosphere, such washing enables the ionic substances on part of the surfaces to be solubilized again and removed, which leads to improvements in charging properties and powder fluidity. Such washing with the acid and alkaline water has an effect of removing isolated wax adhering to the surfaces of the toner particles. The washing is effectively performed by using a stirrer or an ultrasonic disperser in addition to adjusting the conditions such as pH at the time of washing, the number of times of washing, temperature at the time of washing; thus, it is suitable. Another process, such as filtration, decantation, or centrifugation, may be performed thereafter; and toner particles are obtained after drying.

The drying process may be, for example, a process involving use of a flash dryer, and examples thereof include drying involving use of a flash jet dryer and a treatment with a fluid bed. In particular, in the case of the drying involving use of a flash jet dryer, the airflow temperature is as described above.

Electrophotography

In the method for forming a scratchable image according to the first exemplary embodiment, the masking pressure toner is pressure-fixed to form the masking layer; hence, the masking layer is suitably formed by electrophotography.

Any of known electrophotographic image forming apparatuses and image forming methods can be used in the first exemplary embodiment.

An image forming apparatus used in the first exemplary embodiment suitably includes an image carrier, a charging unit that serves to charge the surface of the image carrier, an electrostatic-charge-image-forming unit that serves to form an electrostatic charge image on the charged surface of the image carrier, a developing unit that accommodates an electrostatic charge image developer containing the masking pressure toner and that serves to develop the electrostatic charge image on the surface of the image carrier with the electrostatic charge image developer to form a toner image, a transfer unit that serves to transfer the toner image formed on the surface of the image carrier to the surface of a recording medium, and a fixing unit that serves to pressure-fix the toner image transferred to the surface of the recording medium.

The fixing unit for the pressure fixing is suitably the above-mentioned fixing unit.

In an image forming apparatus used in the first exemplary embodiment, a method for forming an image is performed, the method including, for example, charging the surface of the image carrier, forming an electrostatic charge image on the charged surface of the image carrier, developing the electrostatic charge image on the surface of the image carrier with an electrostatic charge image developer containing a masking pressure toner to form a toner image, transferring the toner image formed on the surface of the image carrier to the surface of a recording medium, and pressure-fixing the toner image transferred to the surface of the recording medium (method for forming an image according to the first exemplary embodiment).

The image forming apparatus used in the first exemplary embodiment may be any of the following known image forming apparatuses: a direct-transfer-type apparatus in which the toner image formed on the surface of the image carrier is directly transferred to a recording medium, an intermediate-transfer-type apparatus in which the toner image formed on the surface of the image carrier is subjected to first transfer to the surface of an intermediate transfer body and in which the toner image transferred to the surface of the intermediate transfer body is then subjected to second transfer to the surface of a recording medium, an apparatus which has a cleaning unit that serves to clean the surface of the image carrier after the transfer of a toner image and before the charging, and an apparatus which has an erasing unit that serves to radiate light to the surface of the image carrier for removal of charges after the transfer of a toner image and before the charging.

In the intermediate-transfer-type apparatus, the transfer unit, for example, includes an intermediate transfer body of which a toner image is to be transferred to the surface, a first transfer unit which serves for first transfer of the toner image formed on the surface of the image carrier to the surface of the intermediate transfer body, and a second transfer unit which serves for second transfer of the toner image transferred to the surface of the intermediate transfer body to the surface of a recording medium.

Electrostatic Charge Image Developer

An example of the electrostatic charge image developer used for forming the masking layer is a developer containing at least the masking pressure toner.

The electrostatic charge image developer used for forming the masking layer of a scratchable image may be a single-component developer containing only the masking pressure toner or a two-component developer that is a mixture of the masking pressure toner and a carrier.

The carrier is not particularly limited, and any of known carriers in the field of the electrostatic charge image developer can be used. Examples of the carrier include coated carriers in which the surfaces of cores formed of magnetic powder have been coated with a coating resin; magnetic-powder-dispersed carriers in which magnetic powder has been dispersed in or blended with a matrix resin; and resin-impregnated carriers in which porous magnetic powder has been impregnated with resin.

In the magnetic-powder-dispersed carriers and the resin-impregnated carriers, the constituent particles thereof may serve as cores and have a surface coated with a coating resin.

Examples of the magnetic powder include magnetic metals, such as iron, nickel, and cobalt, and magnetic oxides such as ferrite and magnetite.

Examples of conductive particles include particles of metals such as gold, silver, and copper; carbon black particles; titanium oxide particles; zinc oxide particles; tin oxide particles; barium sulfate particles; aluminum borate particles; and potassium titanate particles.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluorine resins, polyester, polycarbonate, phenol resin, and epoxy resins.

The coating resin and the matrix resin may contain other additives such as a conductive material.

An example of a technique for coating the surface of the core with the coating resin is a technique that involves coating with a coating-layer-forming solution in which the coating resin and optionally a variety of additives have been dissolved in a proper solvent. The solvent is not particularly limited and may be determined in view of, for instance, the type of coating resin to be used and coating suitability.

Specific examples of the technique for coating with resin include dipping in which the cores are dipped in the coating-layer-forming solution; spraying in which the surfaces of the cores are sprayed with the coating-layer -forming solution; a fluid bed process in which the coating -layer-forming solution is sprayed in a state in which the cores are allowed to float by flowing air; and a kneader -coater process in which the cores of the carrier and the coating-layer-forming solution are mixed with each other in a kneader-coater and then the solvent is removed.

The mixing ratio (mass ratio) of the toner to the carrier in the two-component developer (toner:carrier) is preferably from 1:100 to 30:100, and more preferably from 3:100 to 20:100.

Scratchable-image-formed Article

A scratchable-image-formed article according to a second exemplary embodiment has a base image formed on a substrate and a masking layer formed by pressure-fixing of the masking pressure toner onto the base image.

The scratchable-image-formed article according to the second exemplary embodiment is properly formed by the method for forming a scratchable image according to the first exemplary embodiment.

In the scratchable-image-formed article according to the second exemplary embodiment, the substrate having the base image, the masking pressure toner, and the masking layer have the same definitions as the substrate having the base image, the masking pressure toner, and the masking layer of a scratchable image in the method for forming a scratchable image according to the first exemplary embodiment, respectively; and suitable examples thereof are also the same.

The scratchable-image-formed article according to the second exemplary embodiment may have at least the masking layer formed on the substrate with a base image by pressure-fixing of the masking pressure toner and includes an article in which the masking layer has been partially removed.

Toner Used for Forming Scratchable Image

A toner used for forming a scratchable image in the second exemplary embodiment is the masking pressure toner.

The masking pressure toner as the toner used for forming a scratchable image in the second exemplary embodiment has the same definition as the masking pressure toner used in the method for forming a scratchable image according to the first exemplary embodiment; and suitable examples thereof are also the same.

An electrostatic charge image developer used in the second exemplary embodiment contains the toner used for forming a scratchable image in the second exemplary embodiment.

The electrostatic charge image developer used in the second exemplary embodiment may be a single-component developer containing only the toner used for forming a scratchable image in the second exemplary embodiment or a two-component developer that is a mixture of the toner used for forming a scratchable image in the second exemplary embodiment and a carrier.

The carrier is not particularly limited and can be suitably the above-mentioned carrier.

A toner cartridge used in the first and second exemplary embodiments accommodates at least the toner used for forming a scratchable image in the first and second exemplary embodiments.

The toner cartridge used in the first and second exemplary embodiments may accommodate the toner used for forming a scratchable image in the first and second exemplary embodiments as the electrostatic charge image developer.

The process cartridge used in the first and second exemplary embodiments is a process cartridge that includes a developer carrier and that accommodates at least the toner used for forming a scratchable image in the first and second exemplary embodiments or the electrostatic charge image developer used in the first and second exemplary embodiments.

It is suitable that the toner cartridge used in the first and second exemplary embodiments be removably attached to an image forming apparatus. In other words, the toner cartridge accommodating the toner used for forming a scratchable image in the first and second exemplary embodiments is suitably used in an image forming apparatus having a structure that enables the toner cartridge to be removably attached.

The toner cartridge may be a cartridge accommodating toner and a carrier or may be a combination of a cartridge independently accommodating the toner and a cartridge independently accommodating the carrier.

The process cartridge used in the first and second exemplary embodiments is suitably detachable from an image forming apparatus.

The process cartridge used in the first and second exemplary embodiments may optionally further include other units such as an erasing unit.

The toner cartridge and the process cartridge may have any of known structures and may have a structure, for example, disclosed in Japanese Unexamined Patent Application Publication Nos. 2008-209489.

EXAMPLES

The exemplary embodiments of the invention will now be described further in detail with reference to Examples and Comparative Example but are not limited thereto. The terms "part" and "%" are on a mass basis unless otherwise specified.

The value of T(1 MPa)−T(10 MPa)=ΔT in toner are determined in the manner described above.

Example 1

Emulsion Aggregation Method

Preparation of Dispersion Liquid of Masking Agent Particles (1)

Aluminum pigment (2173EA manufactured by SHOWA ALUMINUM POWDER K.K.): 100 parts

Anionic surfactant (NEOGEN R manufactured by DKS Co. Ltd.): 1.5 parts

Ion exchanged water: 900 parts

These materials are mixed with each other after a solvent is removed from the paste of the aluminum pigment. Then, the mixture is subjected to dispersion for an hour with an emulsifying disperser CAVITRON (CR1010 manufactured by Pacific Machinery & Engineering Co., Ltd) to prepare a dispersion liquid of metal pigment particles (concentration of solid: 10%) in which highly bright pigment particles (aluminum pigment) have been dispersed.

Dispersion Liquid of Resin particles (1): Preparation of High Tg resin

Styrene: 450 parts n-butylacrylate: 150 parts

Acrylic acid: 12 parts

Dodecanthiol: 9 parts

These materials are mixed with each other and dissolved to prepare a solution.

This solution is added to another solution of 20 parts of an anionic surfactant (DOWFAX2A1 manufactured by The Dow Chemical Company) in 250 parts of ion exchanged water and then dispersed and emulsified in a flask (monomer emulsified liquid A).

Another solution of 3 parts of an anionic surfactant (DOWFAX2A1 manufactured by The Dow Chemical Company) in 555 parts of ion exchanged water is prepared and put into a polymerization flask.

The polymerization flask is tightly sealed and provided with a reflux tube. The polymerization flask is heated to 75° C. in a water bath under slow stirring while nitrogen is supplied thereto, and the flask is held in this state.

A solution of 9 parts of ammonium persulfate in 43 parts of ion exchanged water is dropped to the polymerization flask with a metering pump over 20 minutes. Then, the monomer emulsified liquid A is dropped to the polymerization flask with a metering pump over 200 minutes. Then, the polymerization flask is maintained to be 75° C. for 3 hours under slow stirring to terminate the polymerization.

Through this process, a dispersion liquid of resin particles (1) having the following properties has been produced: median particle size of 180 nm, glass transition temperature of 51° C., weight average molecular weight of 29,000, and solid content of 42 mass %.

Dispersion Liquid of Resin particles (2): Preparation of Low Tg resin

Styrene: 100 parts 2-ethylhexyl acrylate: 500 parts

Acrylic acid: 12 parts

Dodecanthiol: 9 parts

These materials are mixed with each other and dissolved to prepare a solution.

This solution is added to another solution of 20 parts of an anionic surfactant (DOWFAX2A1 manufactured by The Dow Chemical Company) in 250 parts of ion exchanged water and then dispersed and emulsified in a flask (monomer emulsified liquid B).

Another solution of 3 parts of an anionic surfactant (DOWFAX2A1 manufactured by The Dow Chemical Company) in 555 parts of ion exchanged water is prepared and put into a polymerization flask.

The polymerization flask is tightly sealed and provided with a reflux tube. The polymerization flask is heated to 75° C. in a water bath under slow stirring while nitrogen is supplied thereto, and the flask is held in this state.

A solution of 9 parts of ammonium persulfate in 43 parts of ion exchanged water is dropped to the polymerization flask with a metering pump over 20 minutes. Then, the monomer emulsified liquid B is dropped to the polymerization flask with a metering pump over 200 minutes. Then, polymerization flask is maintained to be 75° C. for 3 hours under slow stirring to terminate the polymerization.

Through this process, a dispersion liquid of resin particles (2) having the following properties has been produced: median particle size of 150 nm, glass transition temperature of −35° C., weight average molecular weight of 28,000, and solid content of 42 mass %.

Production of Toner

Dispersion liquid of masking agent particles (1): 50 parts (metallic pigment: 5 parts)

Dispersion liquid of resin particles (1): 70 parts (resin: 29.4 parts)

Dispersion liquid of resin particles (2): 100 parts (resin: 42 parts)

Polyaluminum chloride: 0.15 parts

Ion exchanged water: 300 parts

These components are well mixed with each other and dispersed in a round stainless steel flask with a homogenizer (ULTRA-TURRAX T50 manufactured by IKA Works, Inc.). The flask was subsequently heated to 42° C. in a heating oil bath under stirring and held at 40° C. for 60 minutes. Then, 30 parts (resin: 12.6 parts) of the dispersion liquid of resin particles (1) is added thereto, and the content is gently stirred.

The pH inside the system is adjusted to be 6.0 with 0.5 mol/L of an aqueous solution of sodium hydroxide, and then the temperature is increased to 90° C. while the stirring is continued. In general, the pH inside the system decreases to 5 or less in a temperature increase to 95° C.; however, in this case, an aqueous solution of sodium hydroxide is additionally dropped to prevent the pH from decreasing to 5.0 or less.

After the reaction, the product is cooled, filtrated, and well washed with ion exchanged water and then subjected to a solid-liquid separation by filtration with a Nutsche funnel under reduced pressure. The product is dispersed again in ion exchanged water at 40° C., stirred for 15 minutes with a stainless steel impeller at 100 rpm, and then washed. This washing procedure is repeated three times. The product is subjected to a solid-liquid separation by filtration with a Nutsche funnel under reduced pressure, and the water content thereof is subsequently adjusted to be 40%. Then, the resulting product is dried with a flash jet dryer at an inlet airflow temperature of 80° C.

The particle size of the resulting toner particles is measured with a Coulter counter, and result of the measurement shows that a cumulative volume average particle size D50 is 6.8 μm and that the index GSDv of volume average particle size distribution is 1.24.

The shape factor SF1 of the toner particles, which is determined by shape observation with LUZEX, is 132.

To 50 parts of the masking pressure toner particles, 1.5 parts of hydrophobic silica (TS720 manufactured by Cabot Corporation) is added. They are mixed with each other with a sample mill to yield a toner with an external additive (masking pressure toner).

T(1 MPa)−T(10 MPa)=ΔT in the masking pressure toner is measured and found to be 40° C., which shows that the masking pressure toner has sufficient baroplastic properties (pressure-plastic properties).

Production of Developer

A ferrite carrier coated with 1 mass % of polymethyl methacrylate (manufactured by Soken Chemical & Engineering Co., Ltd.) and having an average particle size of 35 μm is prepared, and the toner with an external additive is weighed so as to have a toner concentration of 8 mass %. The carrier and the toner are stirred and mixed with each other for 5 minutes with a ball mill to prepare a developer.

Production of Scratchable-image-formed Article

This developer is placed in a modified machine of Docuprint P200b manufactured by Fuji Xerox Co., Ltd. In this machine, the roller of the fixing unit is changed to a stainless steel roller having a diameter of 20 mm; in addition, the roller is skewed, so that pressure fixing in which the total load of 150 kgf is applied to enable even fixing without application of heat can be performed.

A non-masked normal image of characters is formed on A4 paper of OK TOPKOTE (127GSM) manufactured by Oji Paper Co., Ltd. with DocuCenter C7550I manufactured by Fuji Xerox Co., Ltd. and thermally fixed.

This thermally fixed image is placed in the modified machine of Docuprint P200b, and the masking layer of a scratchable image is formed on the characters by pressure fixing of the masking pressure toner to produce a scratchable-image-formed article in which the thermally fixed image has been masked. Although the image is held to light, the masked characters cannot be seen. Even when the masking layer is rubbed with KimWipes, any dirt cannot be found. Table 1 shows result thereof.

The masking layer of the scratchable image can be removed by being scratched with a 10-yen coin as in general scratchable images, and the characters can be seen (grade: G1).

Evaluation of Visibility of Base Image

The visibility is evaluated as follows.

The produced scratchable-image-formed article is manually scratched with a 10-yen coin, and then the visibility of the base image thereof is visually observed and evaluated on the basis of the following criteria.

G1: Clearly visible

G2: Visible with some uneven removal of mask

G3: Poorly visible with partial removal of base image

G4: Invisible with removal of base image

Evaluation of Fixability of Masking Layer of Scratchable Image

The produced scratchable-image-formed article is manually rubbed with KimWipes (manufactured by NIPPON PAPER CRECIA Co., LTD.), and the dirt on the KimWipes is visually observed and evaluated on the basis of the following criteria.

G1: No dirt

G2: Slight dirt

G3: Great dirt with removal of masking image

Evaluation of Masking Properties of Masking Layer of Scratchable Image

The produced scratchable-image-formed article is held to 40 W of a straight tube fluorescent lamp, and the visibility of the base image thereof is visually observed and evaluated on the basis of the following criteria.

G1: Base image invisible

G2: Base image slightly and partially visible

G3: Base image visible

Example 2

Dissolution and Suspension Method

The dispersion liquid of resin particles (1) is mixed with low-Tg latex involving 2-ethyl hexyl acrylate (CE6400 manufactured by DIC Corporation, Tg: approximately −40° C.) at a solid content of 50 mass % for each. Water is removed therefrom with a hot-air dryer in order to yield a resin (3). The resin (3) itself after the drying is opaque and clouded and found to be in a phase separation in a micro scale.

Preparation of Toner Solution (Oil Phase)

Aluminum Pigment (2173EA manufactured by SHOWA ALUMINUM POWDER K.K.): 5 parts

Resin (3): 100 parts

Tetrahydrofuran (THF): 300 parts

Ethyl acetate: 300 parts

These materials are mixed with each other and subjected to dispersion for three hours in a ball mill using zirconia balls to produce a toner solution.

Preparation of Dispersion Liquid of Calcium Carbonate

Calcium carbonate (LUMINUS manufactured by Maruo Calcium Co., Ltd.): 200 parts

Anionic Surfactant (NEOGEN RK manufactured by DKS Co. Ltd.): 5 parts

Ion exchanged water: 400 parts

These materials are mixed with each other and subjected to dispersion for two hours in a ball mill using zirconia balls.

Then, 900 parts of ion exchanged water is added thereto, and the mixture is uniformly blended by using a homogenizer to produce a dispersion liquid of calcium carbonate.

Production of Toner and Developer

The toner solution is added to the dispersion liquid of calcium carbonate under operation of the homogenizer for emulsification.

The solvent is removed over 3 hours under heating at 35° C.

Then, 400 parts of 1-N hydrochloric acid (1 normal, 1 mol/L) is added thereto to dissolve the calcium carbonate. The resulting product is filtrated through a 15-micron nylon mesh, sufficiently washed with ion exchanged water, and subjected to a solid-liquid separation by filtration with a Nutsche funnel under reduced pressure.

The product is dispersed again in ion exchanged water at 40° C., stirred for 15 minutes with a stainless steel impeller at 100 rpm, and then washed. This washing procedure is repeated three times, and the resulting product is subjected to a solid-liquid separation by filtration with a Nutsche funnel under reduced pressure. A slight amount of ion exchanged water is subsequently added thereto, and the resulting product is kneaded. Then, the kneaded product is dried with a freeze dryer to produce masking pressure toner particles.

The particle size of the masking pressure toner particles is measured with a Coulter counter, and result of the measurement shows that a cumulative volume average particle size D50 is 8.5 μm and that the index GSDv of volume average particle size distribution is 1.28.

The shape factor SF1 of the toner particles, which is determined by shape observation with LUZEX, is 128.

T(1 MPa)−T(10 MPa)=ΔT in this toner is measured and found to be 38° C., which shows that the toner has sufficient baroplastic properties.

A masking pressure toner and a developer are produced as in Example 1.

A scratchable image is formed and subjected to the same evaluations, and results of the evaluations show that the scratchable image has no problems with the visibility of a base image and easy removal of a masking layer. Table 1 shows results of the evaluations.

Example 3

Mixing of Toners

Production of Toner and Developer

A transparent pressure-plastic toner is produced as in Example 1 except that the dispersion liquid of metallic pigment particles is not used.

The particle size of this transparent pressure-plastic toner is measured with a Coulter counter, and result of the measurement shows that a cumulative volume average particle size D50 is 5.9 μm and that the index GSDv of volume average particle size distribution is 1.23.

The shape factor SF1 of the toner particles, which is determined by shape observation with LUZEX, is 130.

T(1 MPa)−T(10 MPa)=ΔT in this transparent pressure-plastic toner is measured and found to be 42° C., which shows that the toner has sufficient baroplastic properties.

This transparent pressure-plastic toner is mixed with a silver toner (thermoplastic toner) dedicated to C1000 manufactured by Fuji Xerox Co., Ltd. at a mass ratio of 25:75 (transparent pressure-plastic toner:silver toner) to yield a masking pressure toner of Example 3. A developer is produced as in Example 1.

A scratchable image is formed and evaluated as in Example 1 except that the total load applied in Docuprint P200b is changed to 200 kgf. Results of the evaluations show that the scratchable image has no problems with the visibility of a base image and easy removal of a masking layer. Table 1 shows results of the evaluations.

Comparative Example 1

Formation of Masking Layer of Thermally Fixing Toner

In the case where the transparent pressure-plastic toner is not used to produce a developer in Example 3 and where the pressure fixing is similarly performed, a masking layer does not have a sufficient fixability (image is removed with fingers). The developer is fixed with the thermally fixing unit of Docuprint P200b at a roller temperature of 180° C. to form a masking layer.

The masking layer is good in fixability and masking properties that are each evaluated as G1.

The masking layer is, however, hard to be removed. Forcible removal of the masking layer causes the base image to be removed along with the surface of paper. Table 1 shows results of the evaluations.

Example 4

Different Type of Base Image

A non-masked normal image of characters is formed on a postcard manufactured by Fuji Xerox Co., Ltd. (A4 postcard with reply card attached, V424) with an ink jet printer PX105 manufactured by SEIKO EPSON CORPORATION.

As in Example 1, a masking layer is formed of the masking pressure toner used in Example 1.

The masking layer is good in fixability and masking properties that are each evaluated as G1.

The removability of the masking part and the visibility of the base image are good as well. Table 1 shows results of the evaluations.

Example 5

Masking Layer with Different Thickness

The masking layer in Example 1 is repeatedly formed without addition of the toner to the developer.

The thickness of a pressure-fixed masking layer, which is measured with a digital micrometer, is 20 microns in the initial stage but has decreased to approximately 6 microns. The masking layer in this state is evaluated. Results of the evaluations shows that the masking layer has a good fixability, slightly poor masking properties, and no problem with visibility after removal of the masking layer. Table 1 shows results of the evaluations.

Example 6

Masking Pressure Toner Involving Polyester with Use of Carbon as Masking Pigment Preparation of Dispersion Liquid of Block Polyester Resin Particles 1,4-cyclohexanedicarboxylic acid: 175 parts by mass 1-mol ethylene oxide adduct of bisphenol A: (2-mol adducts in terms of two ends): 310 parts by mass Dodecylbenzenesulfonic acid: 0.5 parts by mass These materials are mixed with each other and put into a reactor equipped with a stirrer. Then, the mixture is subjected to polycondensation in a nitrogen atmosphere at 100° C. for 4 hours to produce a uniformly transparent amorphous high-Tg (50° C.) resin compound. The weight average molecular weight of the resin compound, which is measured by GPC, is 5,000.

Caprolactone: 90 parts by mass

Dodecylbenzenesulfonic acid: 0.2 parts by mass

These materials are mixed with each other and put into a reactor equipped with a stirrer. Then, the mixture is subjected to polycondensation in a nitrogen atmosphere at 90° C. for 5 hours to produce a uniformly transparent crystalline low-Tg (−50° C.) polyester oligomer.

The weight average molecular weight of the oligomer, which is measured by GPC, is 6,000; and the crystalline melting point thereof is 60° C. These two resins are mixed with each other at 100° C. and heated in a reactor equipped with a stirrer for 2 hours to produce a block copolymer. The glass transition temperature (onset) of the block copolymer, which is measured by DSC, is 54° C., and the melting point thereof is observed in a small scale in the vicinity of 65° C.

The weight average molecular weight of the block copolymer, which is measured by GPC, is 11,500.

To 100 parts by mass of this resin, 0.5 parts by mass of sodium dodecylbenzenesulfonate (soft type) as a surfactant is added, and 300 parts by mass of ion exchanged water is further added. These are well mixed with each other and dispersed in a round glass flask with a homogenizer (ULTRA-TURRAX T50 manufactured by IKA Works, Inc.) under heating at 80° C.

The pH inside the system is subsequently adjusted to be 5.0 with 0.5 mol/L of an aqueous solution of sodium hydroxide, and then the temperature is increased to 90° C. while the stirring with the homogenizer is continued, thereby producing an emulsified dispersion liquid of a block copolymer resin. A dispersion liquid of block polyester resin particles is produced, of which the resin particles have a median size of 180 nm and the solid content is 20 mass %.

Preparation of Dispersion Liquid of Masking Agent Particles (2)

Carbon black (R330 manufactured by Cabot Corporation): 50 parts by mass

Anionic surfactant [dodecylbenzenesulfonic acid (soft type)]: 5 parts by mass

Ion exchanged water: 200 parts by mass

These materials are mixed with each other and dissolved; then, the mixture is subjected to dispersion for 5 minutes with a homogenizer (ULTRA-TURRAX manufactured by IKA Works, Inc.). The mixture is further subjected to dispersion for 10 minutes with an ultrasonic bath to produce a dispersion liquid of masking agent particles (2) of which the median size is 190 nm and the solid content is 21.5 mass %.

Production of Masking Pressure Toner

Dispersion liquid of block polyester resin particles: 210 parts by mass (resin: 42 parts by mass)

Dispersion liquid of masking agent particles (2): 40 parts by mass (carbon black: 8.6 parts by mass)

Polyaluminum chloride: 0.15 parts by mass

Ion exchanged water: 300 parts by mass

These components are well mixed with each other and dispersed in a round stainless steel flask with a homogenizer (ULTRA-TURRAX T50 manufactured by IKA Works, Inc.). The flask was subsequently heated to 42° C. in a heating oil bath under stirring the content therein and then held at 42° C. for 60 minutes. Then, 105 parts by mass of the dispersion liquid of block polyester resin particles (resin: 21 parts by mass) is added thereto, and the content is gently stirred.

The pH inside the system is subsequently adjusted to be 6.0 with 0.5 mol/L of an aqueous solution of sodium hydroxide, and then the temperature is increased to 95° C. while the stirring is continued. In general, the pH inside the system decreases to 5.0 or less in the temperature increase to 95° C.; however, in this case, an aqueous solution of sodium hydroxide is additionally dropped to prevent the pH from decreasing to 5.5 or less.

After the reaction, the product is cooled, filtrated, and well washed with ion exchanged water and then subjected to a solid-liquid separation by filtration with a Nutsche funnel under reduced pressure. The resulting product is dispersed again in 3,000 parts by mass of ion exchanged water at 40° C., stirred for 15 minutes at 300 rpm, and then washed. This washing procedure is repeated five times. The resulting product is subjected to a solid-liquid separation by filtration with a Nutsche funnel under reduced pressure and then subjected to vacuum drying for 12 hours to yield toner particles.

The particle size of the toner particles is measured with a Coulter counter, and result of the measurement shows that a cumulative volume average particle size D50 is 5.0 μm and that the index GSDv of volume average particle size distribution is 1.24. The shape factor SF1 of the toner particles, which is determined by shape observation with LUZEX, is 129.

To 50 parts of the masking pressure toner particles, 1.5 parts of hydrophobic silica (TS720 manufactured by Cabot Corporation) is added. They are mixed with each other with a sample mill to yield a toner with an external additive (masking pressure toner).

T(1 MPa)−T(10 MPa)=ΔT in the masking pressure toner is measured and found to be 37° C., which shows that the masking pressure toner has sufficient baroplastic properties (pressure-plastic properties).

A developer is produced and evaluated as in Example 1.

A scratchable-image-formed article with a thermally fixed image being masked is produced. Although the image is held to light, the masked characters cannot be seen. Even when the masking layer is rubbed with KimWipes, any dirt cannot be found.

The masking layer of the scratchable image can be removed by being scratched with a 10-yen coin as in general scratchable images, and the characters can be seen.

Table 1 shows results of the evaluations.

Example 7

Different Mixture Ratio of Transparent Pressure-plastic Toner to Thermally Fixing Toner The transparent pressure-plastic toner is mixed with a silver toner dedicated to C1000 manufactured by Fuji Xerox Co., Ltd. at amass ratio of 40:60 (transparent pressure -plastic toner:silver toner) to produce a masking pressure toner of Example 7.

The toner is subjected to the same evaluations as Example 3. The toner has no problems with fixability (G1). The masking properties is slightly unsatisfactory although the base image cannot be seen (G1). The base image after removal of the masking layer is well visible. Table 1 shows results of the evaluations.

Example 8

Different Type of Substrate

A postcard manufactured by Fuji Xerox Co., Ltd. (A4 postcard with reply card attached, V424, 132.5 GSM) replaces A4 paper of OK TOPKOTE (127GSM) used in Example 1 and manufactured by Oji Paper Co., Ltd. A non-masked normal image of characters is formed with DocuCenter C75501 manufactured by Fuji Xerox Co., Ltd. and thermally fixed.

The produced scratchable-image-formed article is subjected to the same evaluations, and results of the evaluations show good fixability, good masking properties, and good visibility of the base image after removal of the masking layer. Table 1 shows the results of the evaluations.

TABLE 1

| | Visibility of base image | Fixability | Masking Properties |
|---|---|---|---|
| Example 1 | G1 | G1 | G1 |
| Example 2 | G1 | G1 | G1 |
| Example 3 | G1 | G1 | G1 |
| Comparative Example 1 | G4 | G1 | G1 |
| Example 4 | G1 | G1 | G1 |
| Example 5 | G1 | G1 | G2 |
| Example 6 | G1 | G1 | G1 |
| Example 7 | G1 | G1 | G1⁻ |
| Example 8 | G1 | G1 | G1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method for forming a scratchable image, the method comprising:

pressure-fixing a masking pressure toner onto a base image on a substrate to form a masking layer, wherein the masking pressure toner is a mixture of a thermoplastic toner and the pressure-plastic toner.

2. The method according to claim 1, wherein the masking pressure toner contains a pressure-plastic toner containing a baroplastic resin.

3. The method according to claim 2, wherein the pressure-plastic toner satisfies the following expression $$20° \text{ C.} \leq T(1 \text{ MPa}) - T(10 \text{ MPa})$$

where T(1 MPa) represents a temperature at which viscosity is approximately $10^4$ Pa·s under an applied pressure of approximately 1 MPa and which is measured with a flow tester, and T(10 MPa) represents a temperature at which viscosity is approximately $10^4$ Pa·s under an applied pressure of approximately 10 MPa and which is measured with a flow tester.

4. The method according to claim 2, wherein the pressure-plastic toner contains two resins, and difference in glass transition temperature between the two resins is approximately 30° C. or more.

5. The method according to claim 4, wherein at least one of the two resins have a glass transition temperature of approximately 40° C. or more.

6. The method according to claim 4, wherein the lower one of the glass transition temperatures of the two resins is approximately less than 10° C.

7. The method according to claim 4, wherein the amount of the resin having a higher glass transition temperature is approximately from 5 mass % to 70 mass % relative to the total mass of the two resins.

8. The method according to claim 1, wherein the mass ratio of the thermoplastic toner to the pressure-plastic toner is approximately from 60:40 to 95:5.

9. The method according to claim 8, wherein the thermoplastic toner contains at least any one of an addition-polymerization resin and a polycondensation resin.

10. The method according to claim 9, wherein a cross-linking agent is used in an amount ranging approximately from 0.05 mass % to 5 mass % relative to the total amount of monomers contained in the addition-polymerization resin.

11. The method according to claim 9, wherein the addition-polymerization resin has a weight average molecular weight ranging approximately from 1,500 to 60,000.

12. The method according to claim 1, wherein the masking pressure toner contains a resin having two glass transition temperatures per molecule.

13. The method according to claim 12, wherein the difference between the two glass transition temperatures is approximately 30° C. or more.

14. The method according to claim 1, wherein the thermoplastic toner contains a masking agent.

15. The method according to claim 14, wherein the masking agent is an aluminum pigment.

16. The method according to claim 1, wherein the base image is in direct contact with the masking layer.

17. The method according to claim 1, wherein the masking pressure toner is pressure-fixed at a pressure ranging approximately from 1 MPa to 20 MPa.

18. The method according to claim 1, wherein the pressure fixing is performed at a temperature ranging approximately from 15° C. to 50° C.

19. A scratchable-image-formed article, the article being produced by the method for forming a scratchable image according to claim 1.

* * * * *